US005160480A

United States Patent [19]

Vassilicos

[11] Patent Number: 5,160,480

[45] Date of Patent: Nov. 3, 1992

[54] TUNDISH TURBULENCE SUPPRESSOR PAD

[75] Inventor: Achilles Vassilicos, Pittsburgh, Pa.

[73] Assignee: USX Corporation, Pittsburgh, Pa.

[21] Appl. No.: 709,468

[22] Filed: Jun. 3, 1991

[51] Int. Cl.[5] ..... B22D 41/00; B22D 41/02

[52] U.S. Cl. ..... 266/275

[58] Field of Search ..... 164/437; 249/206; 266/275, 287, 236, 283

[56] References Cited

U.S. PATENT DOCUMENTS

| | | | |
|---|---|---|---|
| 2,763,906 | 9/1956 | Sterick | 249/206 |
| 2,807,846 | 10/1957 | Sterick et al. | 249/206 |
| 2,855,644 | 10/1958 | Sterick | 249/206 |
| 2,874,427 | 2/1959 | Sterick | 249/206 |
| 2,933,788 | 4/1960 | Sterick | 249/206 |
| 3,865,175 | 2/1975 | Listhuber et al. . | |
| 3,887,171 | 6/1975 | Neuhaus . | |
| 4,042,229 | 8/1977 | Eccleston | 266/275 |
| 4,043,543 | 8/1977 | Courtenay et al. | 266/275 |
| 4,177,855 | 12/1979 | Duchateau et al. | 164/437 X |
| 4,372,542 | 2/1983 | Chia | 266/229 |
| 4,671,499 | 6/1987 | Ishiyama et al. | 266/275 |
| 4,711,429 | 12/1987 | Diederich et al. | 266/44 |
| 4,913,403 | 4/1990 | Plowman et al. | 266/44 |
| 4,993,692 | 2/1991 | Brown et al. | 266/229 |
| 5,072,916 | 12/1991 | Soofi | 266/275 |

FOREIGN PATENT DOCUMENTS

| | | | |
|---|---|---|---|
| 2643009 | 3/1978 | Fed. Rep. of Germany | 266/275 |

*Primary Examiner*—J. Reed Batten, Jr.
*Attorney, Agent, or Firm*—W. F. Riesmeyer, III

[57] ABSTRACT

A pouring pad is provided for use in a tundish during sequence continuous casting. The pouring pad has a plurality of concentric primary ridge portions adjacent to the location of impact of a pouring stream from a ladle with the pad. The primary ridge portions are of a height within a range for creating pockets of recirculation so as to dissipate turbulence without deflection of molten metal from its radially outward flow along the pad. The radial spacing between adjacent primary ridge portions as measured between top inner edge surfaces at corresponding radial points is at least 2.0 times the height of the inner of the adjacent primary ridge portions.

24 Claims, 3 Drawing Sheets

TUNDISH TURBULENCE SUPPRESSOR PAD

BACKGROUND OF THE INVENTION

This invention relates to a pouring pad adapted to be mounted in a tundish so as to receive the impact of a stream of molten metal to be poured into the tundish. The pouring pad of this invention has at least one upwardly projecting ridge of a configuration designed to suppress turbulence within the metal bath in the tundish.

In the continuous casting process, molten steel is supplied to the casting machine in heat lot batches produced at the steelmaking facilities of the plant. Each batch is contained in a ladle which receives molten steel from a furnace and is then transferred to the casting machine. The ladle is positioned over a tundish at the casting machine. Molten steel is then poured through a nozzle in the bottom of the ladle into the tundish. When one ladle is emptied, it is moved away and another full ladle is transferred into position over the tundish. During ladle transfer, molten steel continues to be withdrawn from the tundish into the casting machine. Consequently, the level of molten steel in the tundish drops until another full ladle is positioned and pouring into the tundish has begun again. The purpose of the tundish is to absorb these discontinuities in the supply of molten steel during ladle transfer and to supply a constant stream of steel to the continuous casting machine.

During the period when pouring of molten steel has begun again after ladle transfer, there is an abrupt increase in the pouring rate from the new ladle to the tundish at a time when the level of molten steel in the tundish is lower than normal (e.g., 10% to 25% less than normal). The impact of the pouring stream with the lower level of molten steel in the tundish causes increased turbulence at the slag-metal interface in the tundish. This leads to entrainment of tundish slag with the molten steel as it is withdrawn from the tundish into the casting machine. In addition, the high interfacial turbulence makes it impossible to maintain a protective cover on the steel in the tundish and to protect it from severe reoxidation when casting aluminum killed steel grades. The result is a degradation in steel cleanliness which can require the downgrading of slabs cast during the ladle change period from critical applications. Cleanliness requirements for drawn and ironed and exposed automotive applications, for example, are very high. Hence from a total of 6 to 7 slabs cast from each heat, the downgrading of 2 slabs cast during the ladle change period decreases the availability of as-cast material for these critical applications (not including subsequent diversions) to about 70 percent. In order to overcome these problems, some steel producers have replaced the ladle-tundish-mold system with a ladle-ladle-mold or ladle-ladle-tundish-mold or ladle-tundish-tundish-mold system. These systems are, however, difficult and expensive to implement since they require major plant layout modifications and the addition of extra facilities or new equipment capabilities. Consequently, there is a great need for alternate means for improving steel cleanliness during non-steady pouring conditions within the framework of the ladle-tundish-mold casting system.

German Offenlegungsschrift 2,643,009 discloses a refractory anti-splash grid for a tundish used in the continuous casting of steel. The grid has a honeycomb of box-shaped channels open at both the top and bottom. The thickness of the grid is from 10 to 200 mm (preferably 40 to 100 mm). The webs which form the channels taper either upwardly or downwardly. A stream of steel from a ladle impacts the grid and is prevented from splashing or spraying in the tundish. The grid of this reference is designed to prevent splash upon the initial impact of molten steel with the grid in the tundish as distinguished from applicant's invention which suppresses turbulence and decreases slag entrainment in the molten steel after initial impact at relatively high levels (e.g., ½ to full height) of steel in the tundish. The reference does not disclose a critical ridge spacing of at least 2.0 times the ridge height.

U.S. Pat. No. 4,042,229, Eccleston discloses a tundish having lower beams 20 to confine the flow of molten metal to the impact area so as to minimize splash. Molten metal collects between the beams to form a reservoir until sufficient metal has been poured to overflow the beams. The beams are expendable in the sense that they are at least partially consumed and must be replaced each time the tundish is emptied of molten metal. The reference discloses beams for preventing splash as distinguished from applicant's invention which suppresses turbulence. The spacing and height of the beams are not disclosed in the reference.

U.S. Pat. No. 4,177,855, Duchateau, et al. discloses a flat pad for receiving the impact of a stream from a ladle to a tundish during the continuous casting of steel. The reference pad does not have ridges, whereas, the pad of applicant's invention does have ridges for suppressing turbulence.

U.S. Pat. No. 3,887,171, Neuhaus disclose having a trough 4 which together with the outer surface of a pouring tube 6 forms a path for higher flow velocity of steel upwardly into soft contact with the slag so as to drive impurities into the slag. The reference trough has walls which extend to the interface of slag and steel in the tundish as distinguished from the ridges of applicant's invention which are of substantially lower height. The reference also discloses barriers 7 which create a turbulence for further driving impurities into the slag. The reference barriers are displaced a substantial distance from the area of the pouring stream as distinguished from the ridges of applicant's invention. Also, the height and spacing of the barriers are not disclosed.

U.S. Pat. No. 3,865,175, Listhuber, et al. discloses a tundish (FIG. 4) having a casting tube 28 with a lateral opening close to its bottom. A shoulder 31 displaced from the lateral opening serves to deflect liquid steel vertically upward to increase its turbulence to within a controlled range so as to create a wave in the slag or casting powder layer. Non-metallic particles contained in the steel are flushed into the layer. The reference shoulder has a height of at least 4 cm. The reference does not disclose a ridge for suppressing turbulence as in applicant's invention, nor ridge spacing within a critical range for suppressing turbulence.

U.S. Pat. No. 4,711,429, Diederich, et al. discloses a tundish having walls spaced on opposite sides of the ladle pouring stream which extend upwardly to a height of at least 40 percent of the normal depth of metal in the tundish. The walls form a mixing box for creating turbulence in the metal in order to mix powdered alloy additions with the metal. The reference mixing box walls are designed to create turbulence rather than to suppress it. Also, the reference walls are higher than the ridges of applicant's invention.

Other references of interest are U.S. Pat. Nos. 4,993,692; 4,671,499; 4,372,542; and 4,043,543.

SUMMARY OF THE INVENTION

According to this invention, a refractory pouring pad is provided for use in a tundish. The pouring pad has a plurality of primary ridge portions protruding from a surface of the pad on which a stream of molten metal is received. The primary ridge portions are concentric about a centerpoint coincident with the point of impact of the molten metal stream with the pouring pad. The primary ridge portions extend longitudinally in a direction at substantially a right angle with respect to the flow of molten metal radially outwardly along said surface from the point of impact. The innermost primary ridge portion is spaced sufficiently from the outer periphery of the stream of molten metal to be received on said surface when the ladle nozzle is fully open so as to permit transfer of the stream from the vertical to a direction parallel to the surface of the pad and formation of a radial wall jet in said direction prior to the stream making contact with said innermost primary ridge portion. At least one of the primary ridge portions extends for substantially 360 degrees around the centerpoint. The height of the primary ridge portions is within a range for creating pockets of recirculation so as to dissipate turbulence without deflection of the molten metal from the radially outward direction of flow thereof. Preferably, the height of the primary ridge portions is within a range of from about 6 mm to about 80 mm. Also, it is preferred that the height of each radially outer primary ridge portion is greater than the height of the next adjacent inner primary ridge portion. The spacing between adjacent primary ridge portions as measured between top inner edge surfaces thereof at corresponding radial points thereon is at least 2.0 times the height of the inner of the adjacent primary ridge portions.

The pouring pad of this invention suppresses turbulence at the surface of molten metal in the tundish. It is especially effective in suppressing turbulence during sequence continuous casting when an interruption in the pouring stream occurs due to transfer of an empty ladle away from the tundish and a new full ladle is positioned thereover. During transfer, the height of molten metal in the tundish drops from about 10 to 25%. Upon the recommencement of pouring from the new full ladle, the pouring pad of this invention suppresses turbulence and decreases entrainment of slag at the molten metal surface.

DESCRIPTION OF THE PREFERRED EMBODIMENT

Figure 1:
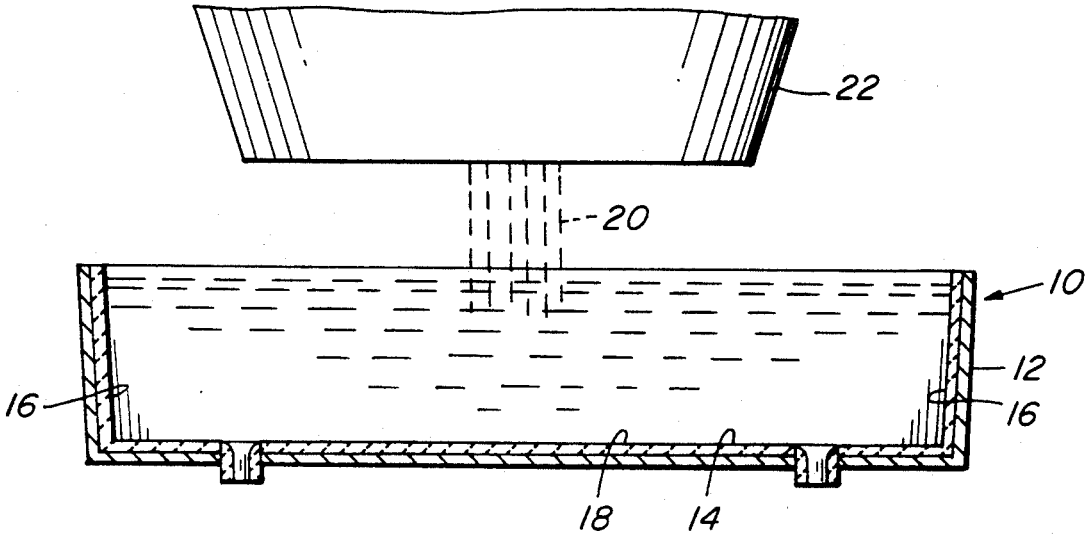
FIG. 1 is a sectional side elevation view of a conventional tundish.
Figure 2:
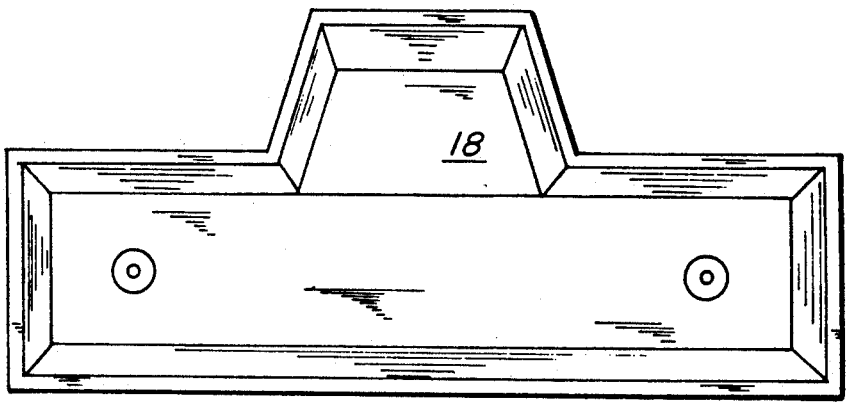
FIG. 2 is a plan view of a conventional tundish.

Referring to FIGS. 1 and 2, tundish 10 has a steel shell 12, a refractory floor 14, refractory walls 16 and a nozzle for transfer of molten metal to a continuous caster mold (not shown). A refractory pouring pad 18 is mounted in the floor of the tundish so as to receive the impact of pouring stream 20 from a ladle 22.

Figure 3:
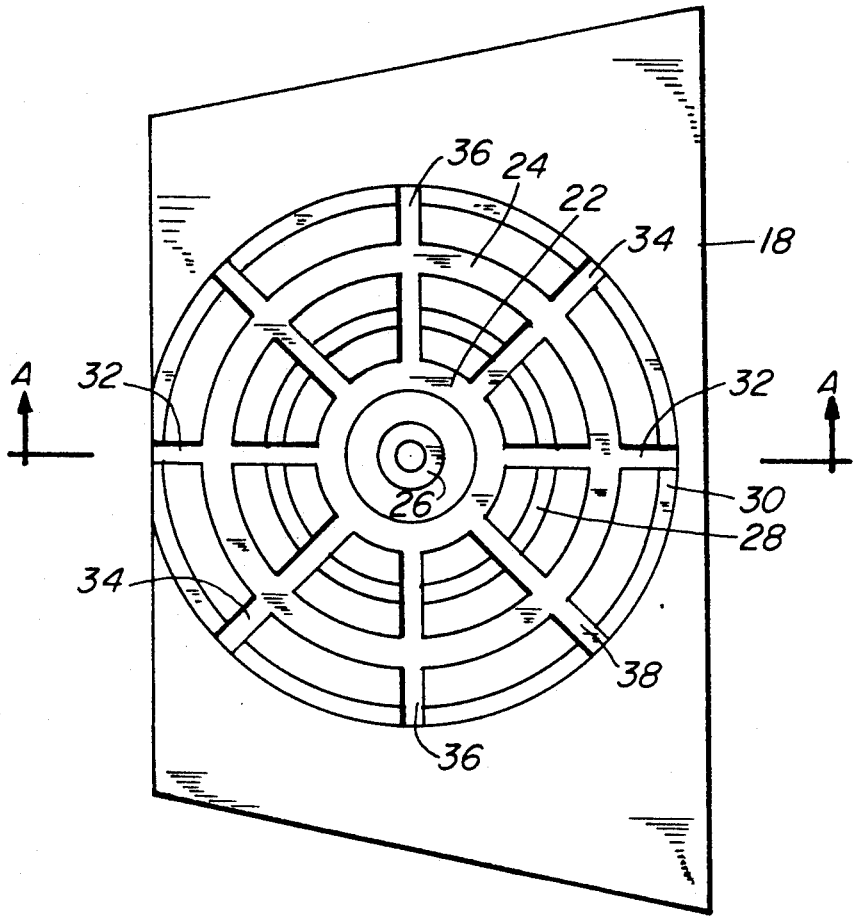
FIG. 3 is a plan view of a pouring pad according to the present invention.
Figure 4:
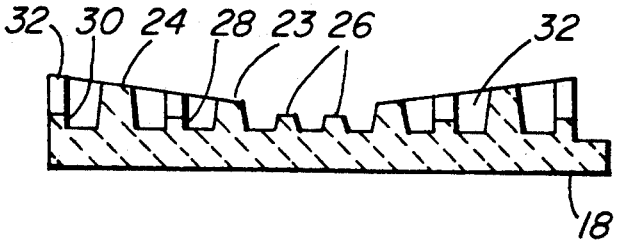
FIG. 4 is a section taken at A—A of FIG. 3.

According to this invention as shown in FIGS. 3 and 4, pouring pad 18 has a plurality of primary ridge portions, including a first primary ridge portion 22 and a second primary ridge portion 24 which project from an upper surface of the pad. The primary ridge portions have a height within a range of from about 6 mm to about 80 mm. The height of the radially outer second primary ridge portion 24 is greater than the height of the first primary ridge portion 22. It is essential for efficient suppression of turbulence at the surface of the molten metal that the spacing between adjacent primary ridge portions as measured between top inner edge surfaces thereof and between corresponding radial points thereon be at least 2.0 times the height of the adjacent inner primary ridge portion. The innermost primary ridge portion is preferably spaced a distance from the centerpoint of impact of the molten metal stream a distance not to exceed 0.75 times the radius of the incoming molten metal stream. The radius of the stream is defined by the radius of the ladle nozzle, or ladle pouring tube if the latter confines the stream. Additional primary ridge portions may be provided within the height and spacing limitations set forth above. The primary ridge portions form pockets of intense recirculatory molten metal flow behind them so as to prevent the formation of reflected or deflected high velocity jets toward the molten metal surface. The primary ridge portions having curvilinear shape in their longitudinal direction and are oriented so as to be substantially perpendicular to the direction of molten metal flow adjacent to the pad surface. This flow direction is predominantly radial and so the primary ridge portions are concentric, centered about the point of impact of the ladle stream. Finally, the centerpoint of the concentric primary ridges is positioned so as to coincide with the center of the ladle pouring stream when the throttling gate is fully open. In this way, during ladle opening and tundish refilling, the pouring stream impacts the pad within the area enclosed by the innermost primary ridge preferably at its centerpoint in order to achieve maximum turbulence suppression. Subsequently, when the steel bath in the tundish has returned to its full height, the ladle stream is throttled back, and it may no longer impact at the center of the primary ridge. However, since turbulence suppression is less critical during steady state casting, the non-optimum position of the impact of the stream relative to the ridges is not significant.

Preferably, secondary ridge portions are provided as shown at 26, 28 and 30 in FIGS. 3 and 4. The height of the secondary ridge portions is less than that of the primary ridge portions, preferably within a range of 25 to 75 percent of the height of adjacent outer primary ridge portion. The secondary ridge portions are located intermediate adjacent primary ridge portions, preferably equidistant therebetween. Additional secondary ridge portions may also be provided interiorly of the innermost primary ridge portion and exteriorly of the outermost primary ridge portion as at 26 and 30, respectively. The secondary ridge portions modify molten metal flow within the pockets of recirculation created between primary ridge portions and increase the efficiency of turbulence suppression.

Also, in the preferred form, a plurality of radial ridge portions 32, 34, 36 and 38 are provided. The radial ridge portions direct any swirling flow of molten metal resulting from misalignment of the ladle stream, i.e., off the centerpoint or at an angle with respect to a vertical direction in a radial direction. This suppresses turbulence which would be caused by such swirling of the molten metal due to misalignment of the ladle stream.

The cross sectional shape of the primary, secondary and radial ridge portions is preferably square or rectangular with sharp corners at the jointure of the sidewalls and upper edge surfaces. For ease of manufacture, some curvature is required. However, a maximum corner radius of about ⅛ inch (3.1 mm) is desired for most efficient turbulence suppression. Rounded cross sectional shapes significantly degrade the performance of the pad. Also, a slight outward taper of the sidewalls may be necessary for manufacturing purposes.

Figure 5:
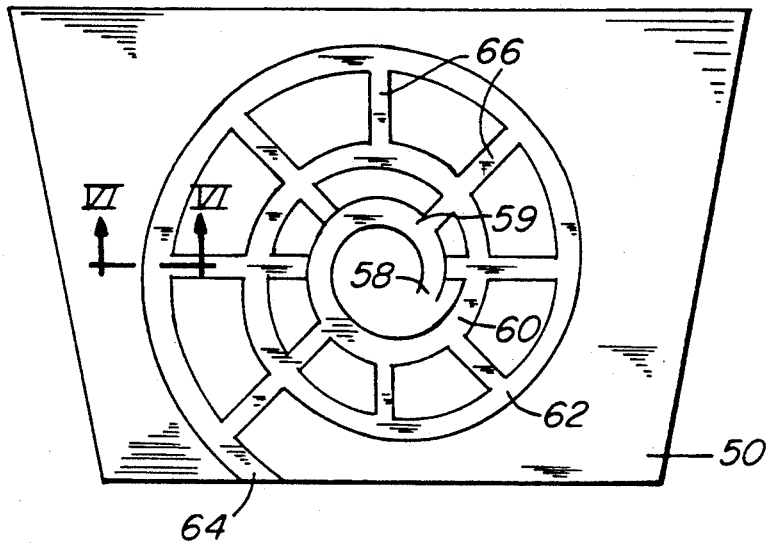
FIG. 5 is a plan view of an alternate embodiment of a pouring pad according to the present invention.
Figure 6:
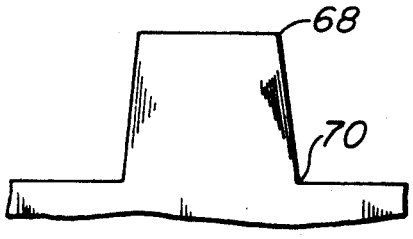
FIG. 6 is an enlarged section taken at VI—VI of FIG. 5.

Referring to FIGS. 5 and 6, an alternative embodiment is shown in which the pouring pad 50 has a first primary ridge portion 52, a second primary ridge portion 54 and a third primary ridge portion 56. The first primary ridge portion extends from point 58 to point 60. The second primary ridge portion extends from point 60 to point 62 and the third primary ridge portion extends from point 62 to point 64. The three primary ridge portions together form a continuous logarithmic spiral defined by the equation:

$$S\text{ (degrees) } 28 = \frac{180.0}{3.14} \times \frac{1}{0.053} + \ln\left(\frac{r}{1.750}\right) - 135.0$$

where r=radius in inches.

The spacing between the primary ridge portions in the logarithmic spiral according to this formula is within the range of 2.0 to 3.0 inches (50.8 mm to 76.2 mm). The height of the three primary ridge portions increases linearally with arc length from 0.25 inches (6.2 mm) at point 59 to 2.5 inches (63.5 mm) at point 64. The height of the ridge tapers from 0.25 inches (6.2 mm) at point 59 to 0 at point 58 for ease of manufacture. The ridges are 1.5 inches (38.1 mm) thick at their top surface 68 and 1.75 inches (44.0 mm) at their base 70 (FIG. 6). A plurality of radial ridge portions 66 are also provided similar to those in the previous embodiment.

I claim:

1. A metal supply vessel, comprising: a refractory floor and refractory walls for containing molten metal in said supply vessel, a nozzle mounted in said refractory floor for draining molten metal from the vessel, and a refractory pad mounted in the floor of said vessel having a surface for receiving a stream of molten metal thereon, said surface having a plurality of protruding primary ridge portions arranged concentrically about a centerpoint of said surface, said primary ridge portions extending longitudinally in a direction at about a right angle with respect to said centerpoint, at least one of said primary ridge portions extending longitudinally three hundred and sixty degrees around said centerpoint, the height of said primary ridge portions being within a range of from about 6 mm to about 80 mm, the radial spacing between adjacent primary ridge portions as measured between top inner edge surfaces thereof at corresponding radial points thereon being at least 2.0 times the height of the inner of the adjacent primary ridge portions, said primary ridge portions permitting formation of a radial wall jet in the molten metal and dissipating turbulence therein.

2. The metal supply vessel of claim 1 wherein the height of each radially outer primary ridge portion is greater than the height of the adjacent inner primary ridge portion.

3. The metal supply vessel of claim 1 wherein the primary ridge portions have essentially flat upper and sidewall surfaces, each sidewall surface joining the upper surface at a substantially right angle with respect thereto.

4. The metal supply vessel of claim 1 further comprising a plurality of secondary ridge portions located intermediate the primary ridge portions, the height of said secondary ridge portions is within the range of 1 to 75 percent of the height of the primary ridge portions.

5. The metal supply vessel of claim 3 wherein the height of any secondary ridge on the inner side of the innermost primary ridge portion does not exceed 50 percent of the height of the innermost primary ridge portion.

6. The metal supply vessel of claim 1 further comprising a plurality of spaced radial ridge portions extending between adjacent primary ridge portions.

7. The metal supply vessel of claim 1 wherein the primary ridge portions are circular.

8. The metal supply vessel of claim 1 wherein the primary ridge portions are joined end-to-end so as to form a spiral shape.

9. The metal supply vessel of claim 8 wherein the height of the primary ridge portions gradually increases along the length thereof from a lower end adjacent the centerpoint to a high end radially outward therefrom.

10. The metal supply vessel of claim 4 wherein the secondary ridge portions are all of the same height.

11. The metal supply vessel of claim 4 wherein the height of each radially outer secondary ridge is greater than the height of the next inner secondary ridge portion.

12. The metal supply vessel of claim 4 wherein the height of the secondary ridge portions is within the range of 35 to 65 percent of the height of the primary ridge portions.

13. A metal supply vessel, comprising: a refractory floor and refractory walls for containing molten metal in said supply vessel, a nozzle mounted in said refractory floor for draining molten metal from the vessel and a refractory pad mounted in the floor of said vessel having a surface for receiving a stream of molten metal thereon, said surface having a plurality of protruding primary ridge portions arranged concentrically about a centerpoint of said surface, said primary ridge portions extending longitudinally in a direction at about a right angle with respect to said centerpoint and radially outwardly therefrom, at least one of said primary ridge portions extending longitudinally three hundred and sixty degrees around said centerpoint, the height of said primary ridge portions being within a range of from about 6 mm to about 80 mm, the height of each radially outer primary ridge portion being greater than the height of the adjacent inner primary ridge portion, the radial spacing between adjacent primary ridge portions as measured between top inner edge surfaces thereof at corresponding radial points thereon being at least 2.0 times the height of the inner of the adjacent primary ridge portions, said primary ridge portions permitting formation of a radial wall jet in the molten metal and dissipating turbulence therein.

14. The metal supply vessel of claim 13 wherein the height of the primary ridge portions is within a range of from about 6 mm to about 80 mm.

15. The metal supply vessel of claim 13 wherein the primary ridge portions have essentially flat upper and sidewall surfaces, each sidewall surface joining the upper surface at a substantially right angle with respect thereto.

16. The metal supply vessel of claim 13 further comprising a plurality of secondary ridge portions located intermediate the primary ridge portions, the height of said secondary ridge portions is within the range of 1 to 75 percent of the height of the primary ridge portions.

17. The metal supply vessel of claim 13 further comprising a plurality of spaced radial ridge portions extending between adjacent primary ridge portions.

18. The metal supply vessel of claim 17 wherein the height of any secondary ridge on the inner side of the innermost primary ridge portion does not exceed 50 percent of the height of the innermost primary ridge portion.

19. The metal supply vessel of claim 13 wherein the primary ridge portions are circular.

20. The metal supply vessel of claim 13 wherein the primary ridge portions are joined end-to-end so as to form a spiral shape.

21. The metal supply vessel of claim 20 wherein the height of the primary ridge portions gradually increases along the length thereof from a lower end adjacent the centerpoint to a higher end radially outward therefrom.

22. The metal supply vessel of claim 17 wherein the secondary ridge portions are all of the same height.

23. The metal supply vessel of claim 17 wherein the height of each radially outer secondary ridge portion is greater than the height of the next inner secondary ridge portion.

24. The metal supply vessel of claim 17 wherein the height of the secondary ridge portions is within the range of 35 to 65 percent of the height of the primary ridge portions.

* * * * *